United States Patent [19]

Di Amico

[11] 4,230,235

[45] Oct. 28, 1980

[54] BEVERAGE CAN HANDLE

[76] Inventor: Paul E. Di Amico, 1180 S. Palm Canyon Dr., Palm Springs, Calif. 92262

[21] Appl. No.: 31,857

[22] Filed: Apr. 20, 1979

[51] Int. Cl.[3] ..... B65D 25/28

[52] U.S. Cl. ..... 220/94 R; 220/1 BC; 229/1.5 H; 229/52 A; D7/9; D7/70

[58] Field of Search ..... 220/85 H, 1 BC, 94 R; 229/1.5 H, 52 A; D7/9, 70

[56] References Cited

U.S. PATENT DOCUMENTS

| | | | |
|---|---|---|---|
| 2,116,148 | 3/1938 | Hawley | D7/70 |
| 2,659,527 | 11/1953 | Liebenow | D7/9 |
| 2,775,382 | 12/1956 | Kayat | 229/52 A |
| 2,926,038 | 2/1960 | Hyams | D7/70 |
| 2,982,458 | 5/1961 | Hennion | 229/1.5 H |
| 3,104,788 | 9/1963 | Wood | 229/1.5 H |
| 3,353,729 | 11/1907 | Hall | 220/85 H |
| 4,127,915 | 12/1978 | Logan | D7/70 |

*Primary Examiner*—George E. Lowrance
*Attorney, Agent, or Firm*—Roger A. Marrs

[57] ABSTRACT

A beverage can having a foldable handle is disclosed herein wherein a cylindrical can includes a metal blank secured to the exterior surface thereof between its opposite ends. The blank comprises a thin sheet of material having a central opening or cut-out defining an upper strip and a lower strip joined at their respective opposite ends by elongated side pieces. Score lines are provided on the strips so that each of the side pieces can be folded over the strips and engaged to provide a handle intended to be grasped by the hand of the user. The inside edge marginal region of the side pieces are contoured to fit the finger grasp of the user's hand. The handle is arranged at a 90 degree angle with respect to the dispensing opening in the top of the can and the lower end of the handle is even with the bottom of the can on a flat surface.

8 Claims, 6 Drawing Figures

FIG. 1
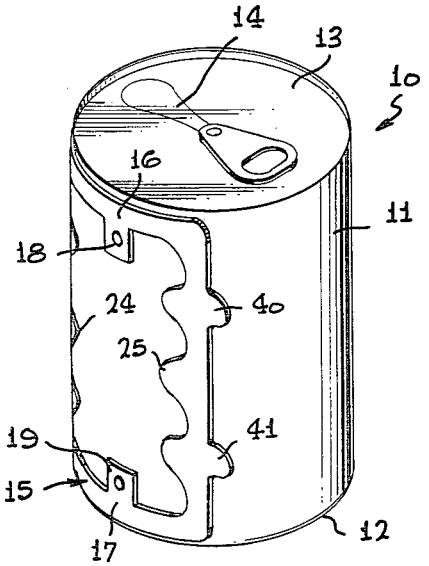
FIG. 2
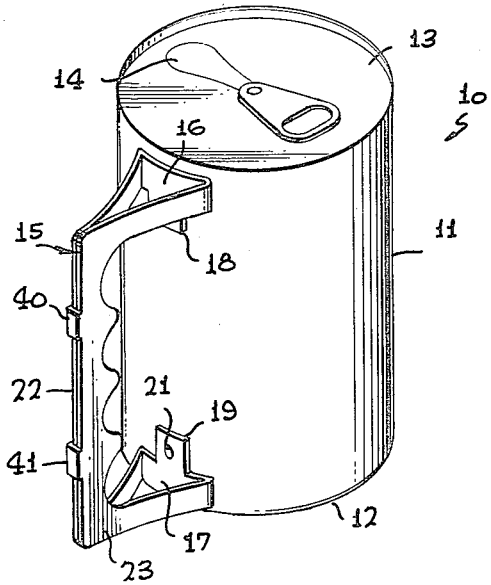
FIG. 4
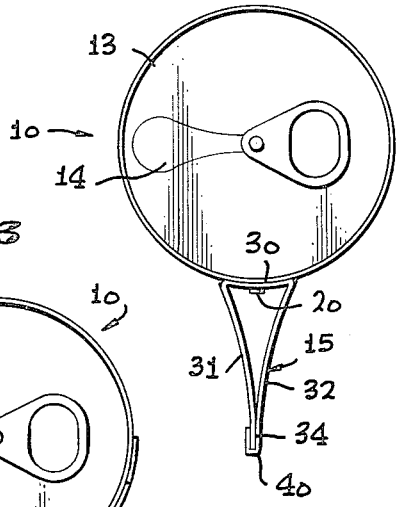
FIG. 3
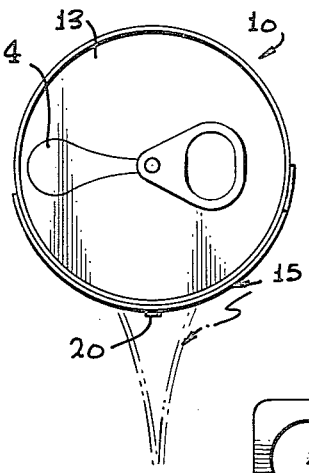
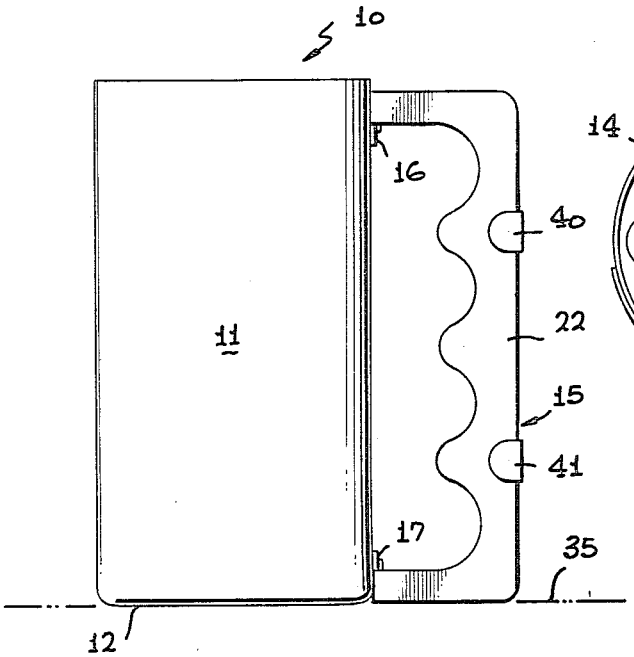
FIG. 5
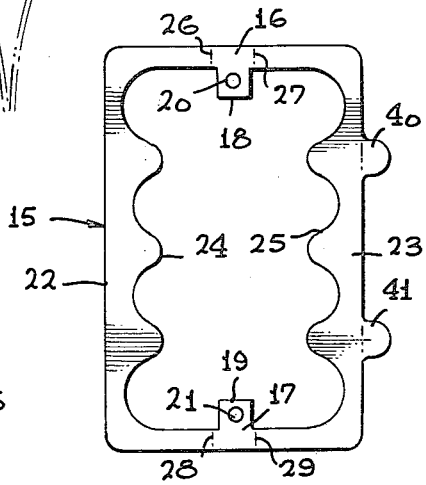
FIG. 6

BEVERAGE CAN HANDLE

BACKGROUND OF THE INVENTION

1. Field of the Invention

The present invention relates to handles for beverage containers or vessels and more particularly, to a novel secured handle carried on a container or vessel having a first position against the external surface of the can and a second position projected from the container or vessel intended to be grasped by the hand of the user.

2. Brief Description of the Prior Art

In the past, it has been the conventional practice to package liquids of an alcoholic or soft drink nature in metal cans. The cans are generally formed with a cylindrical central body of metal which is closed at its opposite ends by an integral bottom deformed into the hollow of the can so that a bottom ridge is present and by a separate top which is placed on the other end of the cylindrical body under a pressure metal deforming device which provides annular bead or ridge. Although these prior beverage containers have been successful in containing the beverage, problems in use have been encountered which stem largely from the fact that the beverage is refrigerated and the metal container is very cold to the hand of the user. Also, the cans are generally stored in a refrigerator or icebox which is a wet environment causing the exterior surface of the can to be slippery and difficult to grasp during consumation of the product.

Therefore, a long standing need has been present to provide a novel means for holding a can so that the consumer may have access to the contents thereof without actually touching the can.

SUMMARY OF THE INVENTION

Accordingly, the above problems and difficulties have been obviated by the present invention which provides a novel means for holding a beverage can while the user consume the liquid product. The invention contemplates a blank of sheet material having a central cut-out defining a top and bottom strip joined at their opposite ends by a pair of side pieces. Fastener means secure the strips to the external surface of the can and score lines join the strip ends with the side pieces so that the side pieces can be folded over into engagement whereby the folded side pieces provide an outwardly projecting handle.

Therefore, it is among the primary objects of the present invention to provide a novel handle and container combination that may be readily folded over from its opposite sides so that the user may hold the can thereby.

Another object of the present invention is to provide a novel handle for beverage cans having a folding aspect whereby connecting elements or side pieces are normally urged into engagement so as to outwardly project from the exterior surface of a beverage can.

Yet another object of the present invention is to provide a novel handle for a beverage can which simulates the handle of a mug.

A further object of the present invention is to provide an inexpensive handle means that is fully secured or installed on a conventional beverage can so that the user may hold the can via the handle means.

Still a further object of the present invention resides in providing a novel handle means and beverage can wherein the handle is permanently installed on the can in the form of a blank which is subsequently folded to provide an outwardly projecting handle.

BRIEF DESCRIPTION OF THE DRAWING

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a front perspective view of a beverage can incorporating the novel handle means of the present invention;

FIG. 2 is a view similar to the view shown in FIG. 1 illustrating the handle means folded over upon itself to provide a handle intended to be grasped by the user;

FIG. 3 is the top plan view of the beverage can shown in FIG. 1 illustrating the handle means in the unfolded position in broken lines;

FIG. 4 is a view similar to the view shown in FIG. 3 with the handle means expanded or folded into the grasping position as shown in FIG. 2;

FIG. 5 is a side elevational view of the beverage can and the handle means as shown in FIG. 4; and FIG. 6 is a front elevational view of the handle means illustrated as a blank prior to being folded into the handle.

DESCRIPTION OF PREFERRED EMBODIMENT

Referring to FIG. 1, the novel beverage can and handle means of the present invention is illustrated in the general direction of arrow 10 which includes a cylindrical container 11 having a bottom 12 at one end and a top 13 at its opposite end closing the container. The top 13 is provided with a conventional closure illustrated in general by the numeral 14. The closure is of the conventional type which may be readily lifted by the fingers of the user wherein a portion of the closure depresses a weakened portion in the top causing an opening to appear through which the beverage may be dispensed.

Fixedly carried on the side of the beverage can 11, there is provided a blank indicated in general by the numeral 15 which is carried on the exterior surface of the can 11 between the opposite ends 12 and 13. As shown more clearly in FIG. 6, the blank 15 includes a pair of end strips 16 and 17 which includes tabs 18 and 19 respectively which are secured to the side of the can by any suitable fastener means such as rivets 20 and 21. The opposite ends of the strips 16 and 17 are joined by vertical pieces or elements 22 and 23. A central opening in the blank 15 defines the end strips 16 and 17 as well as the side pieces or elements 22 and 23. It is to be noted that the contour of the opposing edge marginal regions of the side elements 22 and 23 are convoluted as indicated by numeral 24 and 25 respectively. These convolutions represent finger grasping or gripping regions when the side pieces or elements 22 and 23 or folded over upon themselves to form a handle. In order to aid in folding the side pieces 22 and 23 towards each other, score lines 26,27, 28, and 29 are provided in the strips 16 and 17 respectively at the general area of juncture with the side pieces or elements 22 and 23.

Therefore, it can be seen that the handle means carried on the can 11 has a first position against the side of the can as shown in FIGS. 1 and 3 in solid lines. However, upon folding of the side element 22 and 23 towards each other, the material about the score lines 26–29 inclusive will bend to permit the side pieces or elements 22 and 23 to engage and thereby, to form a handle as shown in FIGS. 2 and 4 respectively.

The material of the blank 15 is deformable; however, upon the completion of the fold as shown in FIGS. 2 and 4, the material will retain its position so that the side elements 22 and 23 will outwardly project from the sides of the beverage can 11. Therefore, the blank 15 has a first position as shown in FIGS. 1 and 3 wherein the blank is form-fitted about the cylindrical body of the can 11 and a second position as shown in FIGS. 2 and 4 wherein the side pieces or elements 22 and 23 are folded outwardly so that a handle is provided. It is to be understood that the handle means is fastened to the can at approximately 90 degrees with respect to the closure or openings means 14. This construction permits right-handed person to grasp the handle in his right hand and comsume the beverage from the opening provided by the closure 14 in a normal manner.

With reference to FIG. 4, it is particularly noted that the end strips 16 and 17 are curved at their engagement with the outside of the can 11 so as to conform therewith. The curve of the strip is shown by numeral 30. It is also to be noted that the side pieces or elements 22 and 23 are curved as represented by numerals 31 and 32 so that the pieces or elements will conform to the curvature of can 11 when the pieces or elements are in the first position as shown in FIGS. 1 and 3. After folding of the side pieces or elements has been complete, the pieces or elements are engaged with one another as indicated by the numeral 34. However, the pieces or elements do diverge from one another when the handle is in its second position to a width defined by the score lines carried on the end strips 16 and 17.

Referring now to FIG. 5, it can be seen that the lower end strip 17 is adjacent to the bottom 12 of the container 11 such that the strip will reside on a supporting surface 35 when the beverage can or container is at rest on the surface. Thus, the can is balanced and stabilized on the surface and will not readily topple or fall over. The portion of the lower strip 17 is outwardly projecting from the can when the side element or pieces are deployed from the first position.

Therefore, it can be seen that the handle means of the present invention provide a novel handle for holding a beverage can which is inexpensive to manufacture, convenient to install and ready for use in a convenient manner. The blank 15 is rigidly secured to the side of the can by suitable means such as adhesive or by rivets. Other fastening means may also be employed. The beverage cans may be transported in the usual manner such as in groups of 6, 12 or any other convenient manner. Inasmuch as the blank 15 is conformed to the rounded contour of the cylindrical can, there is no waste of space and storage and handling of the cans or containers does not pose a problem. When it is desired to consume the contents of the can, the side elements 23 and 24 are merely rotated towards one another until their extreme peripheral edge regions engage. At this time, the end strips 16 and 17 will bend about the score lines until the side pieces or elements have been completely deployed into their engaged position. This procedure is easily performed by the user by using his hands and no external tools or other implements are required for deployment. The handle is disposable or re-usable as the case may be along with the further or end use of the can itself. To some extent, depending on material, the side pieces or elements 22 and 23 may be folded back to their original position against the external surface of the can 11. The can may then be refilled and the handle subsequently deployed to its fully extended and engaged position ready for use.

Closure tabs 40 and 41 may be employed for folding over the adjacent side element from which they are carried for retaining the side elements together.

While particuler embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. Handle means and beverage can combination comprising:

a beverage can having a sidewall of cylindrical configuration of substantially equal cross sectional thickness presenting a continuous, circular exterior surface separated by a top end and bottom end;

handle means permanently secured to said beverage can exterior surface having a first position flush thereagainst and a second position folded over upon itself to outwardly project from said beverage can exterior surface without reduction of beverage can wall thickness;

said handle means comprising a pair of spaced apart end strips adjacent said top and said bottom respectively with a pair of side elements vertically disposed joining the respective opposite ends of said end strips so that a central opening is defined therebetween;

said end strip adjacent said beverage can bottom is co-extensive therewith so as to cooperatively support said beverage can on a flat surface;

said handle means further having an oval configuration in its first position and a substantially U-shaped configuration in its second position.

2. The invention as defined in claim 1 wherein:

said top end includes a releasable closure means for dispensing the contents of said beverage can and said handle means extending outwardly from said exterior surface normal to said closure means.

3. The invention as defined in claim 2 wherein:

said handle means includes a convoluted edge marginal region along the opposing edges of said side element defined by said central opening.

4. The invention as defined in claim 3 wherein:

each of said end strips includes score lines at locations joining with said side elements presenting areas of reduced thickness for bending said handle means between said first and said second positions.

5. The invention as defined in claim 4 wherein:

said handle means in said first position represents a blank of sheet material curved in top plan view to conform to said circular exterior surface of said beverage can.

6. The invention as defined in claim 5 wherein:

each of said end strips includes a tab between said side elements; and fastener means joining said tabs to said beverage can.

7. The invention as defined in claim 6 wherein:

said side elements touch in engagement when said handle means is in said second position.

8. The invention as defined in claim 7 including:

a pair of closure tabs carried on a selected one of said side elements adapted to fold over against said other side element to retain said side elements together.

* * * * *